United States Patent [19]

Roy

[11] Patent Number: 4,646,659

[45] Date of Patent: Mar. 3, 1987

[54] RADIATION SHIELDING DOOR

[75] Inventor: Ranjit Roy, Mt. Prospect, Ill.

[73] Assignee: The Austin Company, Cleveland, Ohio

[21] Appl. No.: 697,714

[22] Filed: Feb. 4, 1985

[51] Int. Cl.[4] ..... E06B 3/34

[52] U.S. Cl. ..... 109/73; 52/169.6; 109/1 S

[58] Field of Search ..... 52/169.6, 173, 64, 204, 52/210; 109/1 S, 73, 87, 64, 81; 49/400, 401

[56] References Cited

U.S. PATENT DOCUMENTS

| | | | |
|---|---|---|---|
| 908,511 | 1/1909 | Spivey | 109/73 |
| 1,051,681 | 1/1913 | Cary | 109/64 |
| 2,049,969 | 8/1936 | Meunier et al. | 109/73 |
| 3,046,914 | 7/1962 | Sandberg | 109/73 |
| 3,110,271 | 11/1963 | Graber | 109/74 |
| 3,498,011 | 3/1970 | Lindgren | 109/73 |
| 4,211,039 | 7/1980 | Taniwaki | 109/73 |
| 4,266,372 | 5/1981 | Taniwaki | 49/358 |

FOREIGN PATENT DOCUMENTS

| | | | |
|---|---|---|---|
| 625704 | 12/1962 | Belgium | 109/64 |
| 2082659A | 3/1982 | United Kingdom | 52/204 |
| 868038 | 9/1981 | U.S.S.R. | 52/169.6 |
| 969873 | 10/1982 | U.S.S.R. | 52/204 |

OTHER PUBLICATIONS

Hilman Incorporated brochure—pp. 3273–3276, Thomas Register Catalog File–1982.

Overly Manufacturing Company brochure on Severe Service Doors, 1980 Sweet's Catalog File on products for general Bldg., 8.10/Ov pp. 1,8,12.

Protective Door Industries brochure, 1980 Sweet's Catalog File on products for general building, 8.10/PRO, pp. 1, 16.

*Primary Examiner*—John E. Murtagh

*Assistant Examiner*—Andrew Joseph Rudy

*Attorney, Agent, or Firm*—Robert F. Hause

[57] ABSTRACT

A radiation shielding door of massive concrete mounted to move parallel to a wall surface adjacent a door opening, while supported on a plurality of roller assemblies which travel along a rail mounted in the floor.

2 Claims, 8 Drawing Figures

RADIATION SHIELDING DOOR

This invention relates to relatively large and heavy doors such as the concrete doors used for shielding against radiation, and particularly to the structure of such doors and the method of construction and of use of such doors.

BACKGROUND OF THE INVENTION

There are several forms of radiation shielding doors that have been used to close doorways of rooms containing apparatus or materials which produce dangerous radiation, such as nuclear plants and cyclotron buildings.

One form of prior construction involves massive concrete doors which are movable in a direction perpendicular to the wall containing the doorway, moved by a large apparatus on the floor pulling the door outward from the doorway and subsequently pushing the door back into the doorway, as the door moves on large railway wheels, and riding on railway tracks mounted on the floor, or flush with the floor.

The above type of radiation shielding door has several undesirable aspects. Although this perpendicularly traveling door is advantageous in that it moves into and fills the doorway in a wall as well as overlapping a portion of the wall around the doorway, the door is located in an undesirable place, straight out in front of the doorway, when it is opened, requiring travel into and out of the doorway to proceed around the side of the door. The railway tracks located under the door and the pocket in the door for containing the wheel form paths for radiation leakage under the door. Railway tracks in the doorway pose a potential problem with some forms of movement through the open doorway. The large apparatus for moving a door wasted a substantial amount of valuable floor space.

SUMMARY OF THE INVENTION

The present invention relates to a massive concrete door mounted on a plurality of small rollers for movement by a rack and pinion drive, mounted over the area of door travel, which travel moves the door diagonally out of the doorway, along a diagonally constructed side of the doorway formed in the doorway wall, on a railway track recessed in the floor. A slideplate cover extending outward from the bottom edge of the door covers the recess in the floor when the door is open.

It is an object of the invention to provide a novel radiation shielding door having improved radiation shielding properties.

It is a further object of the invention to provide this improved shielding with a construction that requires less floor space and results in improved traffic patterns when the door is opened.

DESCRIPTION OF PREFERRED EMBODIMENTS

Figure 1:
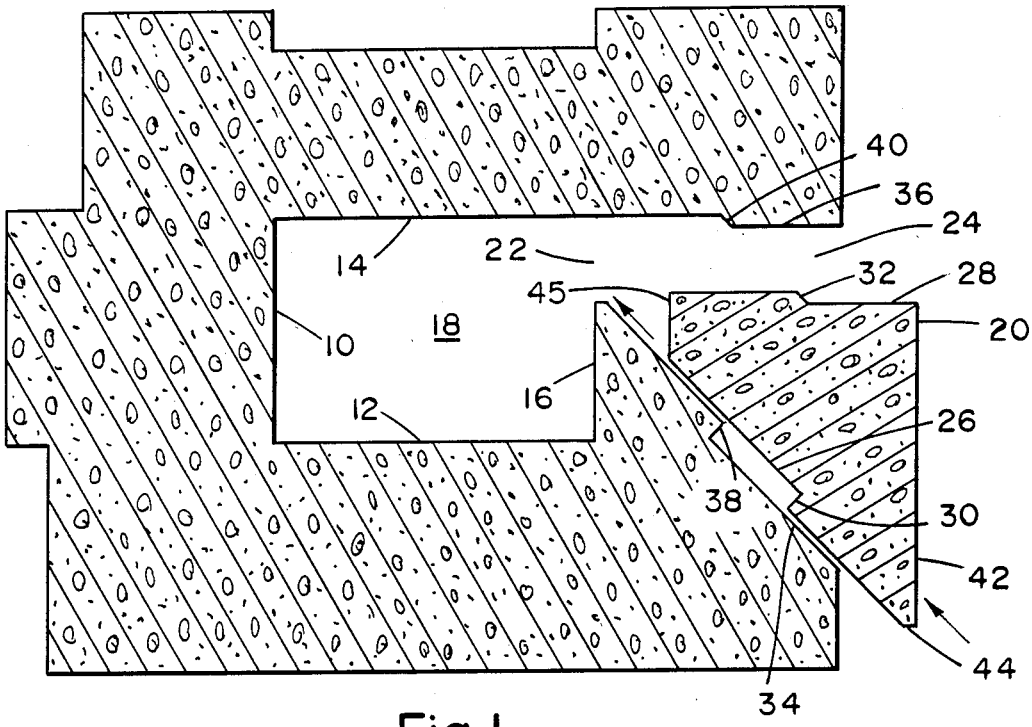
FIG. 1 is a cross-sectional plan view of a room with massive radiation shielding walls and a massive radiation shielding door, embodying the present invention, in an open position, mounted for movement between an open and closed position.

Referring to FIG. 1, there is shown a back wall 10, side walls 12 and 14 and a front wall 16 forming room 18. A massive steel reinforced concrete door 20 is shown in an open position, leaving a straight, uninterrupted pathway through doorway 22, door 20 being disposed to the side of the doorway 22.

Door 20 has a thickness substantially equal to the thickness of walls 10, 12, 14 and 16, which door and walls may be about ten feet thick, of reinforced solid concrete. Door 20 and front wall opening 24 both have the form of a truncated right triangle.

The hypotenuse or angled side 26 and the perpendicular side 28 of door 20 each have respectively short steps 30 and 32. The angled side 34 and the perpendicular side 36 of wall opening 24 each have respectively short steps 38 and 40, which are complementary to the steps 30 and 32 in door 20, and which are preferably formed at angles as near to 90° as possible while still permitting opening and closing of door 20 and while also being disposed in closely spaced relation when door 20 is closed. These steps will be seen to avoid, when the door 20 is closed, what would otherwise be a direct path for radiation leakage, between the sides of the door and the wall opening sides.

Figure 2:
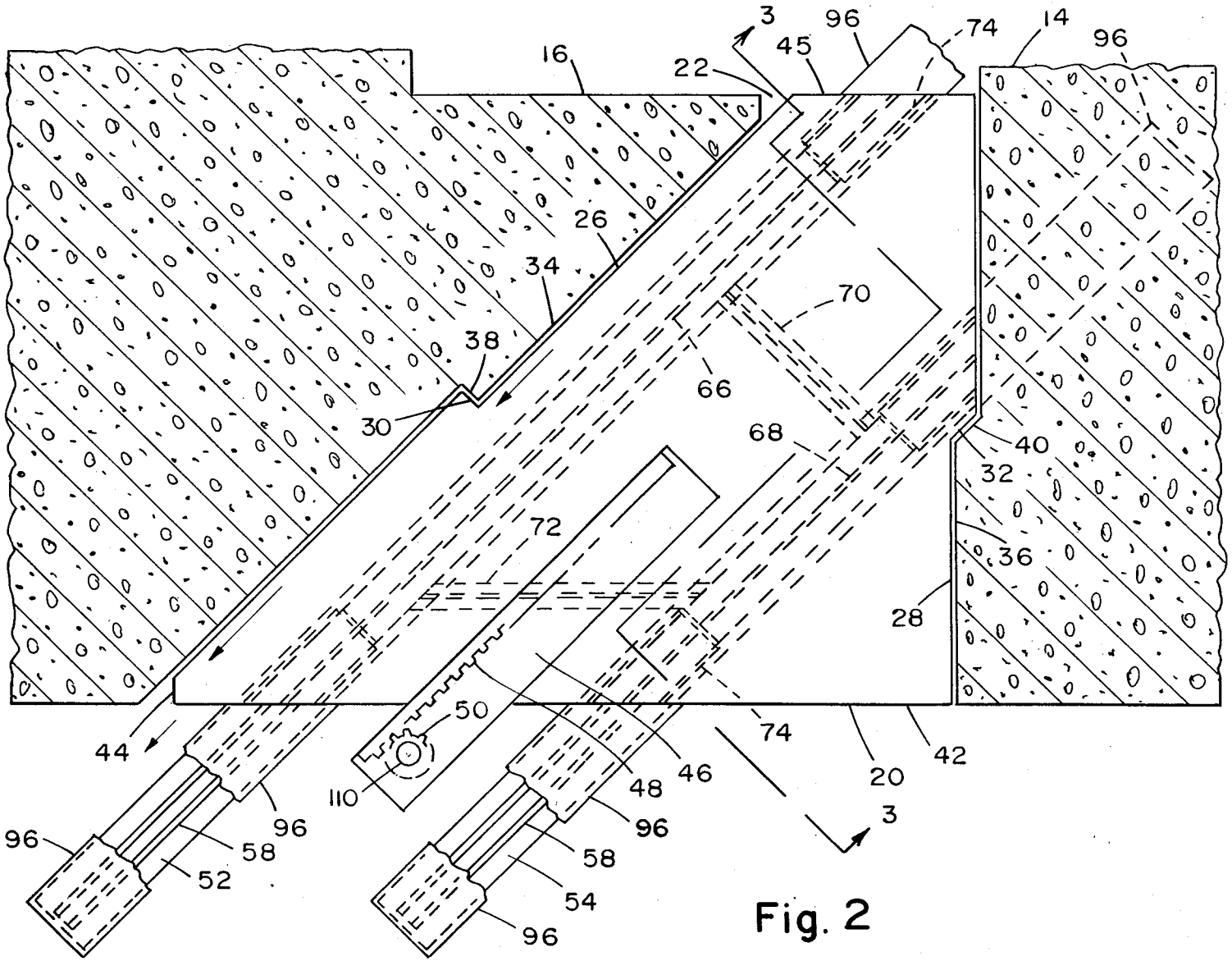
FIG. 2 is an enlarged plan view of the portion of FIG. 1 including the door, adjacent wall area, in a closed position, with portions of the drive mechanism and the floor track being shown.

As will be seen from FIGS. 1 and 2, the door 20 is mounted for movement, between opened and closed positions, solely and entirely through its movement, by moving along the angled side 34 of wall opening 24, moving parallel thereto, with the hypotenuse or angled side 26 of door 20 being always very closely spaced relative to the opening angled side 34.

To avoid a sharp, relatively thin, corner between the angled side 26 of door 20 and the door outer side 42, a small portion of corner is omitted forming narrow side wall 44.

Door 20 is formed with a right angle at one corner in order to provide a doorway which extends perpendicularly through front wall 16. It will be understood that the right angled corner of door 20 could be formed with substantially smaller angles, for example 45°, similar to the angle between the angled side 26 and the door outer side 42, resulting in a doorway extending through the front wall at 45° when such a door is opened.

Door 20 has a relatively narrow inner side 45, formed by the truncated nature of the door shape, which is preferably about four feet wide to provide, when door 20 is open, a doorway 22 of about four feet width.

Referring to FIG. 2, the door 20 is shown closed, substantially completely filling the front wall opening 24. In the top of door 20 is a depression 46 of sufficient width, length and depth to accommodate drive rack 48 and pinion 50, which function to open and close door 20 by drive means, to be discussed further below.

Under door 20 are two parallel trenches 52, 54 in floor 56. A rail 58 is mounted in each trench 52, 54, on each of which rides two roller assemblies 60. One trench 52 extends parallel to and spaced slightly inward from the angled side 34 of front wall opening 24. The second trench 54 is parallel to trench 52, spaced away from angled side 34, over half the width of door 20 therefrom. Four roller assemblies 60, two on each rail 58, support door 20, as will be described further herebelow.

Figure 3:
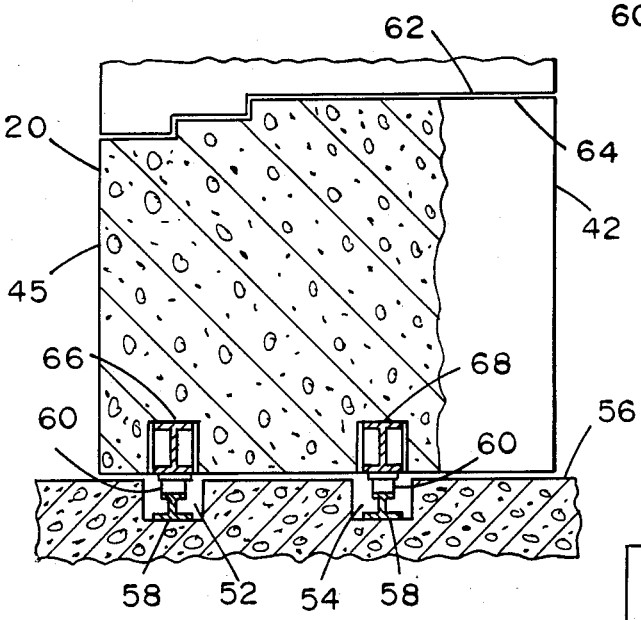
FIG. 3 is a vertical cross-sectional view of the door of FIG. 1, taken on line 3—3, and including a section of adjacent floor and ceiling.

In FIG. 3, door 20 is shown in a vertical cross section of floor 56, door 20 and ceiling 62. The top 64 of door 20 and the ceiling 62 are stepped in a complementary relationship, permitting opening of the door 20 while avoiding a direct path for radiation leakage.

Door 20 is built on a preassembled base frame of W14 beams, as shown in FIGS. 2 and 3. Two W14×90 beams 66 and 68 extend in a direction parallel to the angled side of door 20, located in the base of the door over trenches 52 and 54. Two W14×34 shorter beams 70 and 72 extend between beams 66 and 68 near opposite ends, as shown.

Figure 4:
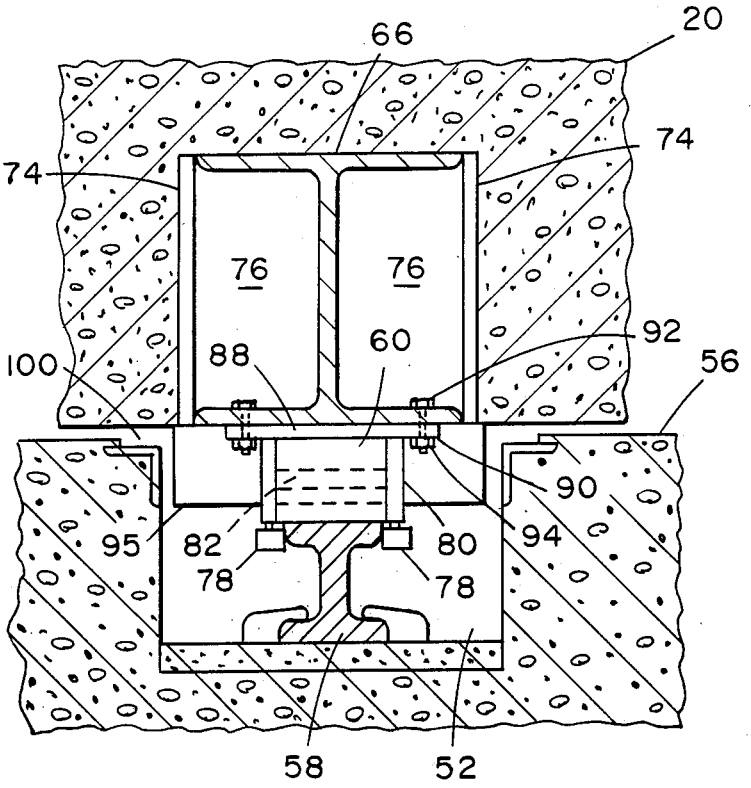
FIG. 4 is an enlarged vertical cross-sectional view of the portion of FIG. 3 including the floor channel, the railway track, the door base frame and the door rollers.
Figure 7:
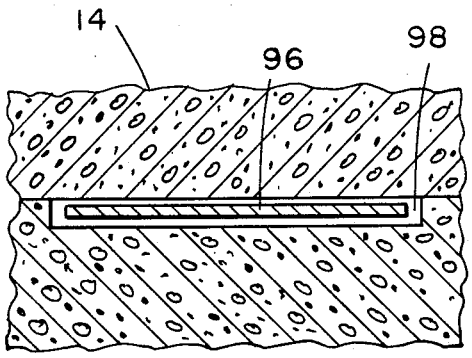
FIG. 7 is a vertical sectional view of the slide plate cover showing the recess in the adjacent wall for containing the slide cover plate when the door is closed.
Figure 5:
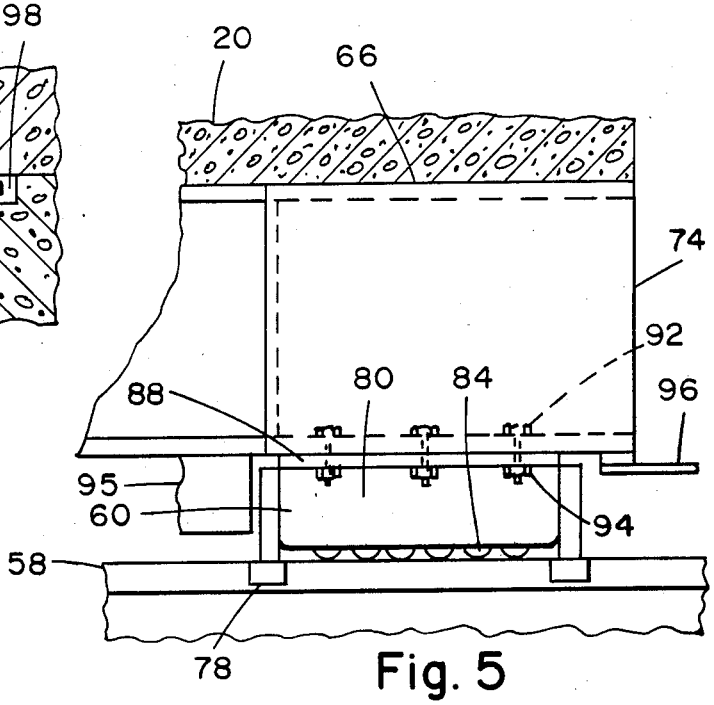
FIG. 5 is a vertical cross-sectional view of the side of the door base frame and the door rollers of FIG. 4.

As shown in FIGS. 4 and 5, the bottom of beam 66, as is true also of beam 68, is flush with the bottom surface of the concrete of door 20. Plates 74 of $\frac{1}{4}$ inch thickness are welded to each side of the beams 66, 68, forming concrete-free hollow spaces 76 along each side at the end of each beam 66, 68, providing access for bolting roller assemblies 60 to the bottom surfaces of the beams 66, 68.

Figure 6:
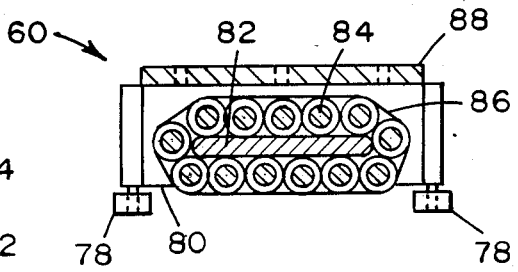
FIG. 6 is a vertical cross-sectional view of the door roller of FIG. 5.

Roller assemblies 60 are of a structure as shown in the cross-sectional view of FIG. 6, and are manufactured and sold by Hilman, Incorporated, and identified as Hilman OT Rollers TM with Hilman Accu Roll TM Type R track follower cams 78 extending downward from each side of the roller assembly side walls 80. Extending betwsen the two side walls 80 of each of the four roller assemblies 60 is a solid flat plate 82, around which roll a plurality of rollers 84, all adjoined together by a pair of link chains 86, one at each end of the plurality of rollers 84. Connecting the two side walls 80 is a heavy top plate 88 which extends out beyond each side wall 80 forming a short side flange 90. Each flange 90 is predrilled and bolts 92 and nuts 94 extend therethrough and affix the roller assemblies 60 to the W14×90 beams 66, 68.

The depth of each trench 52, 52 is sufficient to contain a rail 58, affixed to the bottom of the trench, and the roller assemblies 60 which roll along the top of the rail 58, guided by the cams 78, with the roller assembly top plate 88 supporting door 20 so that the door remains spaced about one inch from the floor 56.

The roller assemblies 60 are mounted with one closely adjacent each end of each W14×90 beam 66, 68. A four-inch steel plate 95 is affixed to the bottom of each W14×90 beam 66, 68, about one and a half feet wide and extending the entire distance between each of the two roller assemblies 60 on each beam 66, 68, avoiding what would otherwise be a direct path for radiation leakage between the door 20 and the floor 56.

As shown in FIG. 5, a tow cover plate 96 is affixed to the bottom of each end of each beam 66, 68, wider than the trenches 52, 54, and extends far enough to cover any open trench 52, 54 as such may become exposed by movement of door 20. Wherever necessary because of the presence of wall 14, a pocket 98 is formed in the wall into which the plate 96 extends, when the door 20 is closed. At the opposite end of the beams 66, 68, the plates 96 are received in a depression 100 in the floor 56 which is equal to the width of the plates 96 and of about the depth of the plate thickness.

Figure 8:
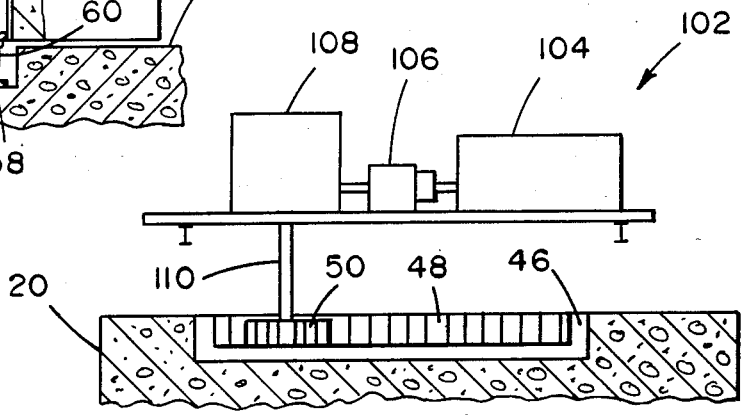
FIG. 8 is a side view of the top of the door showing the drive mechanism mounted above the door.

As shown in FIG. 8, the drive mechanism 102 for opening and closing the door 20, including a drive motor 104, a fluid coupling 106, and a gear box 108 from which a drive shaft 110 extends for rotating pinion 50, is located over the top of door 20, leaving all floor space around the door 20 free.

In a modified form of the invention, the rail has a top surface flush with the floor, an end section of the long beams is disposed above the bottom plane of the door and the roller assemblies are disposed with the bottom flush with the floor and the rail top, avoiding the need for tow cover plates to cover trenches.

Having completed a detailed disclosure of the preferred embodiments of my invention to that those skilled in the art may practice the same, I contemplate that variations may be made without departing from the essence of the invention or the scope of the appended claims.

I claim:

1. A radiation shielding structure comprising a room formed of massive concrete walls, including a wall having a wall opening, and a massive concrete door for filling said wall opening, said wall opening in said wall having on each side of said wall opening a surface of a portion of said wall including a vertical surface on a first side of said opening and a vertical surface on a second side of said opening, said surface on a first side of said opening being at an angle to said surface on said second side of said opening, said door being mounted on rolling means which permit movement of said door solely along the surface on one of said sides of said opening which result in movement of said door away from or toward the other of said sides, said movement producing, respectively, opening or closing of said doorway, and said door having a top with a depression in said top of said door, said depression having therein a rack which engages a pinion, driven from above by suitable drive means, for opening and closing said door.

2. A radiation shielding structure as defined in claim 1 wherein there is a floor within said room and extending to areas outside said door opening and wherein all parts of said drive means are disposed above said door, leaving said floor area around the door free.

* * * * *